US010174654B2

(12) United States Patent
Häberle et al.

(10) Patent No.: US 10,174,654 B2
(45) Date of Patent: Jan. 8, 2019

(54) MUFFLER AND METHOD FOR MANUFACTURING SAME

(71) Applicant: Eberspächer Exhaust Technology GmbH & Co. KG, Neunkirchen (DE)

(72) Inventors: Jürgen Häberle, Stuttgart (DE); Thomas Rose, Leutenbach (DE); Michael Ihring, Ostfildern (DE); Arnulf Spieth, Ostfildern (DE); Benjamin Hirsch, Reichenbach (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 134 days.

(21) Appl. No.: 15/299,794

(22) Filed: Oct. 21, 2016

(65) Prior Publication Data

US 2017/0159520 A1 Jun. 8, 2017

(30) Foreign Application Priority Data

Dec. 7, 2015 (DE) ..... 10 2015 224 453

(51) Int. Cl.
*F01N 13/18* (2010.01)
*F01N 1/08* (2006.01)
*G10K 11/16* (2006.01)

(52) U.S. Cl.
CPC ..... *F01N 1/083* (2013.01); *F01N 1/089* (2013.01); *F01N 13/1838* (2013.01); *G10K 11/161* (2013.01); *F01N 2470/00* (2013.01); *F01N 2490/02* (2013.01); *F01N 2490/08* (2013.01)

(58) Field of Classification Search
CPC ..... F01N 1/089; F01N 13/1838; F01N 13/185
USPC ..... 181/264, 271
See application file for complete search history.

(56) References Cited

U.S. PATENT DOCUMENTS 3,589,469 A * 6/1971 Hasui ..... F01N 1/00 181/232
3,987,868 A 10/1976 Betts
4,278,147 A * 7/1981 Watanabe ..... F01N 1/08 181/256
6,659,222 B1 * 12/2003 Allman ..... F01N 1/02 181/268

(Continued)

FOREIGN PATENT DOCUMENTS

DE 19 24 298 A1 7/1970
EP 1 967 709 A1 9/2008

(Continued)

*Primary Examiner* — Jeremy Luks
(74) *Attorney, Agent, or Firm* — McGlew and Tuttle, P.C.

(57) ABSTRACT

An internal combustion engine exhaust system muffler (1) has a housing (2) within which two chambers (3) are formed with an inner panel (4) arranged therebetween. The inner panel (4) has at least one collar (8) at the edge, which has an outer side (9) facing the housing (2), and wherein the housing (2) has, on an inner side (11), in the area of the inner panel (4), at least one contour (12), which faces the collar (8) and with which the collar (8) is in contact. Reduced noise generation, reduced wear as well as prolonged service life can be achieved with the outer side (9) of the collar (8) forming a cone structure (10) in profile and the contour (12) of the housing (2) forms a cone structure seat (13) with a complementary cone profile and with which the cone (10) is flatly and non-positively in contact.

18 Claims, 4 Drawing Sheets

(56) References Cited

U.S. PATENT DOCUMENTS

| | | | | |
|---|---|---|---|---|
| 7,942,240 | B2 * | 5/2011 | Olsen | F01N 1/084<br>181/238 |
| 7,967,107 | B2 * | 6/2011 | Han | F01N 1/083<br>181/212 |
| 9,062,581 | B2 * | 6/2015 | Usa | F01N 1/089 |
| 2010/0083482 | A1 * | 4/2010 | Wirth | F01N 3/2892<br>29/469.5 |
| 2015/0292375 | A1 * | 10/2015 | Shaya | F01N 1/04<br>181/264 |

FOREIGN PATENT DOCUMENTS

| | | | |
|---|---|---|---|
| EP | 2 354 483 | A2 | 8/2011 |
| JP | S59 155528 | A | 9/1984 |

* cited by examiner

MUFFLER AND METHOD FOR MANUFACTURING SAME

CROSS REFERENCE TO RELATED APPLICATIONS

This application claims the benefit of priority under 35 U.S.C. § 119 of German Application 10 2015 224 453.9 filed Dec. 7, 2015, the entire contents of which are incorporated herein by reference.

FIELD OF THE INVENTION

The present invention pertains to a muffler for an exhaust system of an internal combustion engine. The present invention pertains, in addition, to a method for manufacturing such a muffler.

BACKGROUND OF THE INVENTION

A muffler usually has a housing, in which one or more chambers may be formed to assume different muffling functions. An intermediate or inner panel, which is supported at its edge on the housing to absorb loads, is advantageously arranged between adjacent chambers in the housing. Furthermore, it is common practice to permanently connect pipes, which extend in the housing, with such an inner panel. Frequent is in this connection a constellation in which such a pipe is fastened to the housing, on the one hand, and to such an inner panel, on the other hand. To avoid thermal stresses, it is advantageous, furthermore, not to fasten the inner panel on the edge to the housing but to arrange the inner panel loosely, preferably in a non-positive (not fixed) manner thereon in order to make possible relative motions caused by thermal effects between the housing and the inner panel. A kind of sliding fit can be formed, in principle, between a collar of the inner panel, which collar extends circumferentially at the edge, and the housing. It is possible for this, in principle, in case of a conventional mode of construction to bend the collar by about 90° in relation to the inner panel. The collar is flatly in contact with its outer side facing the housing radially with an inner side of the housing at least at ambient temperature in the mounted state.

The relative terms "axial" and "radial" pertain to a normal axis, which is located at right angles on a plane in which the respective inner panel extends.

The temperature of the muffler rises during the operation of the exhaust system, and the housing, on the one hand, and the respective pipe and the respective inner panel, on the other hand, may undergo different thermal expansions. This is due, on the one hand, to the fact that the different components reach different temperatures. On the other hand, the pipes carrying exhaust gas within a muffler and the housing are usually manufactured from different materials, which possess different coefficients of thermal expansion. In particular, the inner panel may be manufactured from the same material as the pipe, so that the intermediate panel will also have an expansion different from that of the housing. However, the different temperatures may also lead to relative motions due to thermal effects even if the different components are manufactured from the same material or from similar materials. Therefore, embodiments in which the housing and the pipe are each manufactured from ferrite or each from austenite are also conceivable.

The heating of the muffler thus causes, on the one hand, an expansion or an adjustment of the pipe in its longitudinal direction relative to the housing. This leads to an axial displacement of the intermediate panel permanently connected to the pipe within the housing. Such an axial displacement can be compensated in a simple manner by the above-described axial sliding fit between the inner panel and the housing. On the other hand, the housing may undergo a greater expansion in the radial direction than the inner panel, for example, when the intermediate panel and the housing consist of different materials. As a consequence, the housing may be lifted off from said collar radially at least in some areas. This leads to the risk of loss of the non-positive connection (not fixed connection) between the housing and the inner panel, which is accompanied by a free mobility between the inner panel and the housing in the radial direction and in the axial direction. Based on vibrations, which occur during the operation of the exhaust system, undesired and disturbing noises may be generated. Further, there is a risk of increased abrasion and wear of the muffler. In addition, there is a risk of a significant damage to the components in case vibrations are induced in the arrangement comprising the pipe and the inner panel in the range of the natural frequency. Even total failure of the muffler may occur in an extreme case.

SUMMARY OF THE INVENTION

This problems noted are to be remedied by the present invention. An object of the present invention is to provide an improved embodiment for such a muffler or for a corresponding manufacturing method, which embodiment is characterized especially by reduced noise generation and/or by reduced wear and/or improved fatigue strength.

According to the invention, a muffler is provided for an exhaust system of an internal combustion engine. The muffler comprises an inner panel and a housing. The inner panel is arranged in the housing and cooperates with the housing to form at least two chambers, with the inner panel between the at least two chambers. The inner panel has at least one collar with an edge, which has an outer side, which faces the housing and forms a cone structure which is a cone, partial cone or frustoconical shaped in profile. The housing has an inner side, in an area of the inner panel, with at least one contour, which faces the collar and forms a cone structure seat which is a cone, a partial cone or frustoconical shaped seat in profile, which is complementary to the cone structure and with which the cone structure is flatly and loosely in contact.

According to another aspect of the invention a method is provided for manufacturing a muffler comprising an inner panel and a housing, the inner panel being arranged in the housing and cooperating with the housing to form at least two chambers, with the inner panel between the at least two chambers, wherein the inner panel has at least one collar with an edge, which has an outer side, which faces the housing and forms a cone structure which is a cone, partial cone or frustoconical shaped in profile, the housing has an inner side, in an area of the inner panel, with at least one contour, which faces the collar and forms a cone structure seat which is a cone, a partial cone or frustoconical shaped seat in profile, which is complementary to the cone structure and with which the cone structure is flatly and loosely in contact and the cone structure and cone structure seat form a conical sliding fit, which permits a relative axial adjustment and a relative radial adjustment between the inner panel and the housing and makes possible the flat contact between the cone and cone structure seat. The method comprises the steps of inserting the inner panel into a lower shell of the housing, placing an upper shell on the lower shell, with the inner panel bulged elastically and fastening the upper shell to the lower shell, while the inner panel is bulged elastically, whereby the housing is subsequently mounted in a radially inwardly prestressed state.

According to another aspect of the invention a method is provided for manufacturing a muffler comprising an inner panel, a housing, the inner panel being arranged in the housing and cooperating with the housing to form at least two chambers, with the inner panel between the at least two chambers, wherein the inner panel has at least one collar with an edge, which has an outer side, which faces the housing and forms a cone structure which is a cone, partial cone or frustoconical shaped in profile, the housing has an inner side, in an area of the inner panel, with at least one contour, which faces the collar and forms a cone structure seat which is a cone, a partial cone or frustoconical shaped seat in profile, which is complementary to the cone structure and with which the cone structure is flatly and loosely in contact and the cone structure and at least one exhaust pipe fastened to the housing and fastened to the inner panel. The method comprises the steps of inserting the inner panel with the exhaust pipe fastened thereto into a lower shell of the housing, placing an upper shell of the housing on the lower shell of the housing, pushing the exhaust pipe radially inwardly until the inner panel bulges elastically and fastening the exhaust pipe to the housing while the inner panel is bulged elastically, whereby the exhaust pipe is subsequently mounted in an axially inwardly prestressed state.

According to another aspect of the invention a muffler for an exhaust system of an internal combustion engine is provided. The muffler comprises an inner panel comprising an outer periphery with at least one collar with a sloped collar edge surface or ramp contour collar edge surface and a housing with an inner side with at least one seat contour surface, which faces the at least one collar edge surface and has a sloped or ramp contour which is complementary to the collar edge surface. The inner panel is arranged in the housing and cooperates with the housing to form at least two chambers, with the inner panel between the at least two chambers and with the sloped collar edge surface or ramp contour collar edge surface in abutting non-positive contact with the seat contour surface.

The present invention is based on the general idea of not aligning the collar axially but sloped in relation to the axial direction and of creating a fitting, complementary contour on the housing, so that the sloped collar is flatly (with an abutting complementary contour) in contact with the sloped contour. The slope angle of the collar in relation to the axial direction is greater than 0° and less than 90°. The slope angle is preferably between 5° and 85°. In particular, the slope angle may be between 15° and 75°. A preferred angle range for the slope angle is between 30° and 60°.

The slope of the collar is seen in the profile of the collar, which is present in a section at right angles to the circumferential direction of the collar. In other words, the collar forms a cone structure that is cone like—a portion of a cone or a frustoconical shape in profile, which cone like shape can be recognized at least in profile, in the muffler according to the invention. While a cone, partial cone or a frustoconical shape is usually circular and rotationally symmetrical in relation to a central longitudinal axis, the cone, partial cone or the frustoconical shape of the cone structure at the collar of the inner panel is not limited to such a circular or rotationally symmetrical geometry. It is important that the cone, partial cone or the frustoconical shape can be recognized in the profile of the collar, namely, that the collar is a sloped collar or has a ramp-like or ramp contour. The cross section of the housing in the area of the inner panel may now have quasi any desired geometry, so that, in particular, circular, elliptical, oval as well as any desired non-round geometries are possible. Cross-sectional geometries with corners are also conceivable, in principle, for example, in the area of a contact zone, in which two housing parts are fastened to one another, if the hosing is a multipart housing and is assembled, e.g., from two half shells.

Thus, while the collar forms a cone or partial cone or frustoconical shape in profile according to the present invention on its outer side facing the housing, the housing is provided on its inner side, in the area of the inner panel, with a circumferential contour, which faces the edge and forms in profile a cone or partial cone or frustoconical shaped seat, which has a shape complementary to that of the cone, or the partial cone or the frustoconical shape. The cone, partial cone or the frustoconical shape and the cone, partial cone or the frustoconical shape are coordinated with one another such that the cone partial cone or the frustoconical shape is flatly in contact e.g., in abutting contact (with a complementary contour) with the cone, partial cone or the frustoconical shaped seat. Further, the cone, partial cone or the frustoconical shape is loosely in contact with the cone, partial cone or the frustoconical shaped seat. The term "being loosely in contact" shall be defined such that the cone, partial cone or the frustoconical shape is in contact with the cone, partial cone or the frustoconical shaped seat, but is not fastened thereto. The contact may be prestressed. The loose contact can also transmit forces between the inner panel and the housing in the direction of shear, so that a non-positive contact or a non-positive connection (not fixed) is also present. The greater the selected value of the prestress possibly provided in the contact between the cone and the cone seat, the stronger is this frictional connection. For example, vibrations can be damped by means of the frictional connection.

It is possible due to the sloped collar and due to the cone or partial cone or frustoconical shape at the collar of the inner panel and due to the complementary contour and the complementary cone, partial cone or frustoconical shaped seat at the housing to maintain a contact between the cone, partial cone or frustoconical shaped seat and the cone in case of a radial expansion of the housing relative to the inner panel when the position of the inner panel also becomes changed axially correspondingly relative to the housing, e.g., due to the expansion of the pipe and/or due to an axial prestress. A contact can thus always be maintained between the inner panel and the housing even in case of thermal expansion effects caused by thermal effects, so that the risk of noise generation as well as a wear or even of a breakdown or failure is reduced.

In case the two chambers, between which the respective inner panel is arranged, are to be separated from one another in a comparatively sealed manner in the area of the collar, it is recommended to configure the collar of the inner panel and the contour of the housing such that they extend fully circumferentially or without interruptions. The flat contact between the cone and the cone, partial cone or frustoconical shaped seat can be guaranteed in this manner without interruptions in the circumferential direction of the collar. If, however, such a sealing is not important in the area of the collar, the collar and/or the contour may also have interruptions in the circumferential direction and be formed by individual circumferential segments only. At least three collar segments, which interact with at least three contour segments, are advantageously provided now. It is likewise conceivable to provide a plurality of collars distributed in the circumferential direction on the inner panel, which interact with a circumferential contour or with a plurality of correspondingly distributed, individual contours.

According to an advantageous embodiment, the inner panel may be axially prestressed, so that the cone is in contact with the cone, partial cone or frustoconical shaped seat in an axially prestressed state. This mode of construction has the advantage that in case the housing widens or expands greatly relative to the inner panel due to thermal effects and the inner panel cannot be sufficiently adjusted due to the expansion of the pipe to compensate this, the inner panel can perform the necessary axial displacement, which is necessary for maintaining the contact between the cone and the cone, partial cone or frustoconical shaped seat, independently. In other words, the inner panel is also adjusted axially automatically due to the axial prestress in case of a radial expansion of the housing in order to maintain the contact between the cone and the cone, partial cone or frustoconical shaped seat.

In another advantageous embodiment, the cone and the cone, partial cone or frustoconical shaped seat may have a conical sliding fit, which permits an axial and radial relative adjustment between the inner panel and the housing, and make, furthermore, possible the flat contact of the cone with the cone, partial cone or frustoconical shaped seat. Such a conical sliding fit combines an axial adjustability with a radial adjustability between the cone and the cone, partial cone or frustoconical shaped seat, so that a flat contact is always guaranteed between the cone and the cone, partial cone or frustoconical shaped seat in all permissible relative positions of the inner panel relative to the housing.

In another advantageous embodiment, the housing can be mounted in a radially inwardly prestressed state, so that the inner panel is bulged elastically in its preferential direction at least at the mounting temperature and the cone, partial cone or frustoconical shape is in contact with the cone, partial cone or frustoconical shaped seat in a prestressed state. Due to this prestressed mounting, expansion effects caused by thermal effects can be taken into account, such that the relative motions resulting here from or during the operation will be smaller and will especially be compensated. The prestress is reduced first by the thermal expansion before a relative motion takes place. As a result, compensation of the thermal expansions can already be achieved in a broad temperature range without relative motions occurring in the process. Such a radial prestress between the housing and the inner panel is facilitated by the cone, partial cone or frustoconical shape and the cone, partial cone or frustoconical shaped seat, because a defined elastic bulging of the inner panel is possible as a result.

According to another advantageous embodiment, the muffler may have at least one exhaust pipe, which is fastened to the housing at one end and to the inner panel, at the other end. It is advantageously an inlet pipe or an outlet pipe, which is led into the housing or out of the housing. Further, the exhaust pipe is advantageously passed through the inner panel. In particular, the exhaust pipe is passed through one chamber, while it opens in the other chamber. The inner panel is indirectly fixed to the housing via this exhaust pipe. In particular, the fastening of the exhaust pipe on the housing forms a fixed mount, while the support of the inner panel on the housing forms a loose mount. Change in the length of the exhaust pipe due to thermal effects thus lead to relative motions between the housing and the inner panel. These may take place through the cone, partial cone or frustoconical shape in conjunction with the cone, partial cone or frustoconical shaped seat, without the flat contact between the cone, partial cone or frustoconical shape and the cone, partial cone or frustoconical shaped seat being jeopardized.

Corresponding to an advantageous variant, the pipe may be mounted in the axially prestressed state, so that the inner panel is bulged elastically in its preferential direction at least at the mounting temperature and the cone, partial cone or frustoconical shape is prestressed and is in contact with the cone, partial cone or frustoconical shaped seat in a non-positive (non-fixed) manner. Just as the above-described radial prestressing between the housing and the inner panel, this measure also leads to an anticipation of thermal expansion effects, but in the axial direction in this case. Consequently, the relative motions between the inner panel and the housing due to thermal effects take place at higher temperatures only, at which the prestress generated during the mounting is reduced. The prestress is preferably selected to be such that a prestress is still present even at high temperatures.

In another variant, the pipe may consist of a first material, for example, a ferritic steel, which has a first coefficient of thermal expansion that is lower than a second coefficient of thermal expansion of a second material, for example, an austenitic steel, of which the housing consists. Thus, the pipe has, per se, a lower coefficient of thermal expansion than the housing, so that it expands to a lesser extent at elevated temperatures than does the housing. However, the pipe is exposed to markedly higher temperatures than the housing, so that the exhaust pipe will expand axially to a greater extent during the operation of the exhaust system than the housing. The inner panel can now be manufactured from the same material as the exhaust pipe, i.e., from the first material, or, like the housing, consequently, from the second material.

In another advantageous embodiment, the inner panel may consist, regardless of whether or not such a pipe is present, of a first material, for example, a ferritic steel, which has a first coefficient of thermal expansion that is lower than a second coefficient of thermal expansion of a second material, for example, an austenitic material, of which the housing consists. As a consequence, the inner panel expands radially to a lesser extent than the housing during the heating of the muffler.

In addition or as an alternative, provisions may be made for the pipe to be manufactured from an austenitic steel, as a result of which it has a relatively high coefficient of thermal expansion and can better adjust the inner panel in the axial direction. As an alternative, provisions may be made for manufacturing the pipe from a ferritic steel as well.

In particular, an embodiment is also conceivable, in which the inner panel and/or the exhaust pipe, on the one hand, and the housing, on the other hand, consist of the same material. As a consequence, the inner panel and the housing in the first case, the exhaust pipe and the housing in a second case and the inner panel, the exhaust pipe and the housing in a third case have the same coefficient of thermal expansion. Relative motions caused by thermal effects can be compensated by the interplay of the cone, partial cone or frustoconical shape and cone, partial cone or frustoconical shaped seat in these cases and in the above-mentioned cases, so that there will be no loss of contact between the inner panel and the housing in the ideal case.

According to another variant, a cone angle or ramp angle, which the cone, partial cone or frustoconical shape and the cone, partial cone or frustoconical shaped seat have in relation to the axial direction, and the coefficients of thermal expansion of the housing, inner panel and exhaust pipe are coordinated with one another such that a radial expansion of the housing relative to the inner panel is compensated by an axial expansion of the exhaust pipe to the housing in the conical sliding fit such that a flat contact continues to be present between the cone, partial cone or frustoconical shape and the cone, partial cone or frustoconical shaped seat. It is known due to the coefficients of thermal expansion of the materials used and due to the temperatures occurring during the operation how the relative positions of the inner panel and housing can change in relation to one another in the axial direction and in the radial direction. This can be taken into account by selecting the cone angle or ramp angle in a suitable manner, so that a flat contact is always guaranteed between the cone, partial cone or frustoconical shape and the cone, partial cone or frustoconical shaped seat. If, for example, the value of the axial adjustment of the inner panel in relation to the housing is approximately equal to the radial adjustment of the housing in relation to the inner panel, the cone angle or ramp angle can be selected to be about 45°. If, by contrast, the axial adjustment is greater than the radial adjustment, the cone angle or ramp angle should be selected to be smaller than 45°. If, by contrast, the radial expansion turns out to be greater than the axial expansion, the cone angle or ramp angle should be selected to be greater than 45°.

The housing may advantageously be configured as a shell construction, so that it has, in particular, a lower shell and an upper shell, which are fastened to one another in a contact area.

In an advantageous embodiment, the housing may have, in the area of the inner panel, on its inner side, a groove-like depression, which is oriented outwardly and meshes with the collar and in which the contour that forms the cone, partial cone or frustoconical shaped seat in profile is located. In this mode of construction, the cone structure (the ramp or the cone, partial cone or frustoconical shape) of the collar and the contour are in contact with the housing quasi on the outside only, so that no structural changes are necessary in the interior in the housing.

It is likewise possible as an alternative to equip the housing with a bead-like elevation in the area of the inner side on its inner side, said elevation being oriented inwardly and the contour that forms the cone, partial cone or frustoconical shaped seat in the profile being located at said elevation. The cone structure of the inner panel and the housing are in contact in this case with the housing on the inside. This mode of construction is advantageous when the space available at the muffler on the outside is comparatively limited or cannot or must not be changed.

A method according to the present invention for manufacturing a muffler of the type described above comprises, according to a first embodiment variant, the following steps: The inner panel is inserted first into a lower shell of the housing. An upper shell is then placed on the lower shell, while the inner panel is elastically bulged in its preferential direction. In other words, the upper shell is placed on the lower shell with a radial prestress, such that the inner panel will elastically bulge in its preferential direction. The upper shell is then fastened to the lower shell, while the inner panel is elastically bulged, so that the housing is subsequently mounted in radially inwardly prestressed state. The advantages of the radially prestressed mounting were described above.

According to a second embodiment variant, the method according to the present invention comprises the following steps: The inner panel with the exhaust pipe fastened to it is first inserted into a lower shell of the housing. An upper shell of the housing is then placed on the lower shell. The exhaust pipe is then pressed inward until the inner panel bulges elastically in its preferential direction. In other words, an axial prestress is generated on the inner panel via the exhaust pipe such that the inner panel will bulge elastically in its preferential direction. The exhaust pipe is then fastened to the housing, while the inner panel is bulged elastically, so that the exhaust pipe is subsequently mounted in the axially inwardly prestressed state. The advantages of the axially prestressed exhaust pipe are described above. The upper shell may be fastened to the lower shell before or after the axial prestressing of the exhaust pipe or simultaneously with the fixation of the exhaust pipe to the housing.

The manufacture of the muffler is carried out at a mounting temperature that is, for example, in a range of about 15° C. to 35° C., depending on the manufacturing site.

It is apparent that the above-mentioned features, which will also be explained below, are applicable not only in the particular combination indicated but also in other combinations or alone without going beyond the scope of the present invention.

Preferred exemplary embodiments of the present invention are shown in the drawings and will be explained in more detail in the following description, in which identical reference numbers pertain to identical or similar or functionally identical components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
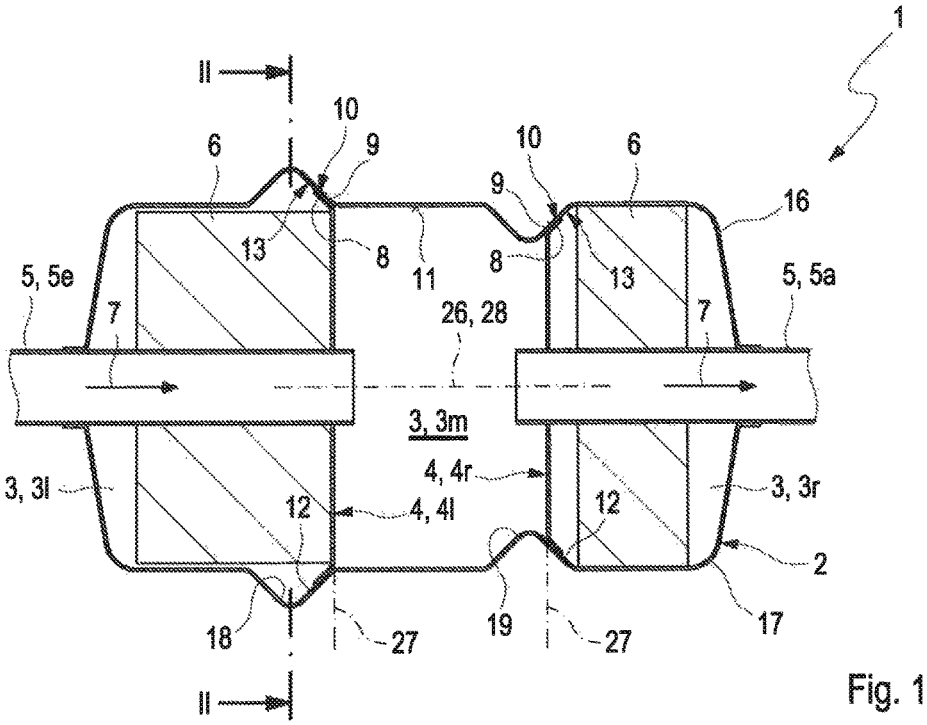
FIG. 1 is a highly simplified longitudinal sectional view of a muffler according to the section lines I-I in FIG. 2.

Referring to the drawings, corresponding to FIGS. 1 through 8, a muffler 1, which is intended for use in an exhaust system of an internal combustion engine, preferably of a motor vehicle, comprises a housing 2, in which at least two chambers 3 are formed, wherein an inner panel 4 is provided between two chambers 3 each in the housing 2. The housing 2 contains exactly three chambers 3 in the example, which can be designated, for distinction, according to the arrangement shown in FIG. 1, by 3*l* for the left chamber, by 3*r* for the right chamber and 3*m* for the middle chamber. Two inner panels 4, which may also be called left inner panel 4*l* and right inner panel 4*r* according to their arrangement in FIG. 1, are correspondingly present in case of three chambers 3.

Figure 2:
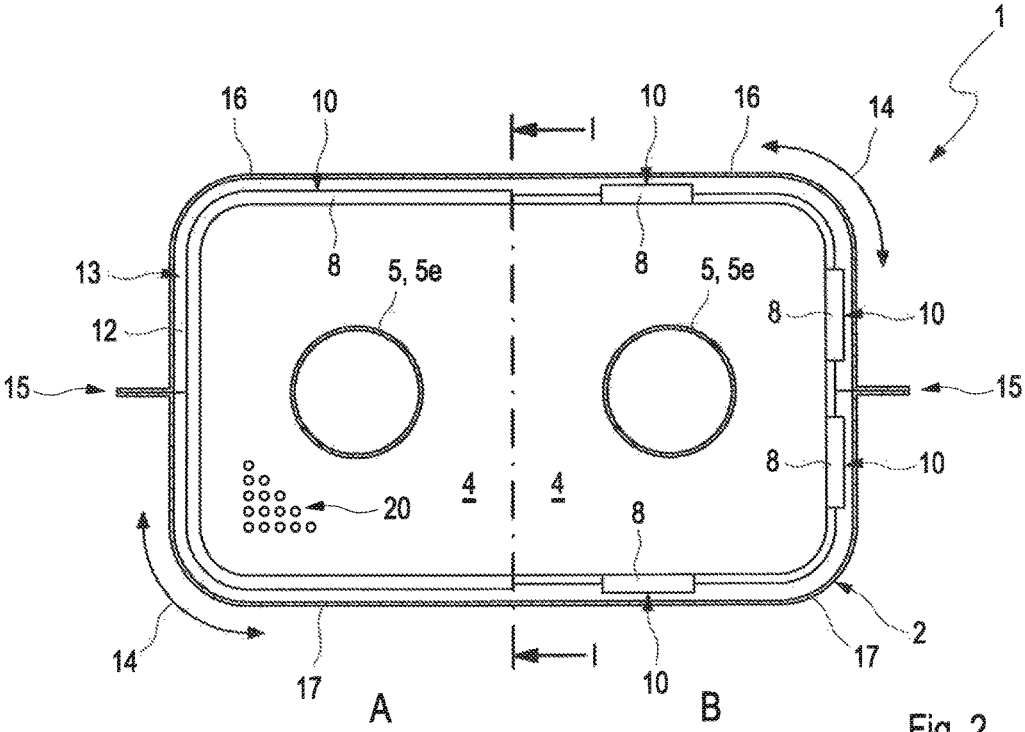
FIG. 2 is a highly simplified cross sectional view of the muffler corresponding to the section lines II-II in FIG. 1, but in two different embodiments A and B.

In addition, the muffler 1 is equipped in the example with at least one exhaust pipe 5, which is fastened to the housing 2 at one end and to such an inner panel 4 at the other end. The muffler 1 has four such exhaust pipes 5 in the example, and only two such exhaust pipes 5 each can be seen in the sectional views shown in FIGS. 1 and 2. A possible section plane I-I of the sectional view in FIG. 1 is indicated in FIG. 2. In case of a hypothetical flow of exhaust gas through the muffler 1 from left to right according to the arrows 7 in FIG. 1, two inlet pipes 5*e* as well as two outlet pipes 5*a* are correspondingly provided. The inlet pipes 5*e* pass through the left chamber 3*l* and open in an open form into the middle chamber 3*m*. The outlet pipes 5*a* pass through the right chamber 3*r* and are arranged in the open form in the middle chamber 3*m*. The middle chamber 3*m* is used here as an expansion chamber as well as an overflow chamber in order to guide the exhaust gas from the inlet pipes 5*e* to the outlet pipes 5*a*. The left chamber 3*l* and the right chamber 3*r* are used here each as expansion chambers and are filled each with a sound-absorbing material 6 for this. This sound-absorbing material 6 is not shown in the sectional view shown in FIG. 2. At least one of the inlet pipes 5*e* and/or at least one of the outlet pipes 5*a* may be provided with a perforation for an acoustic coupling of the absorption chambers 3*l* and 3*r*. An embodiment in which the exhaust pipes 5 are not perforated is likewise possible. The acoustic coupling is brought about now via a perforation 20 in the respective inner panel 4, which said perforation can be seen in FIG. 2 and is formed as an example by a plurality of openings. The absorption chambers 3*l*, 3*r* are thus coupled acoustically through the perforated inner panels 4*l*, 4*r* with the expansion chamber 3*m*, which is, in turn, coupled elastically with the exhaust stream 7 via the exhaust pipes 5. Further, a combination of the two variants is also possible, so that, on the one hand, the left chamber 3*l* is coupled acoustically through a perforated inlet pipe 5*e* and a perforated left inner panel 4*l* and/or, on the other hand, the right chamber 3*r* is coupled acoustically through a perforated outlet pipe 5*a* and a perforated right inner panel 4*r*.

The respective inner panel 4 has at least one collar 8 at the edge, which has an outer side 9 facing the housing 2. According to the longitudinal sections shown in FIG. 1 as well as 3 through 8, this outer side 9 forms a cone structure (a cone, partial cone or frustoconical shape in profile) 10. The housing 2 has at least one contour 12 facing the collar 8 on its inner side 11 facing the chambers 3 in the area of the respective inner panel 4. In the profile of the sectional views, this contour 12 forms a cone, partial cone or frustoconical shaped seat 13, which is complementary to the cone structure 10 and with which the cone structure 10 is in contact flatly (with a complementary contour) and loosely, preferably in a non-positive (not fixed) manner. As can be seen, the cone 12 and the cone, partial cone or frustoconical shaped seat 13 taper axially in the direction in which the exhaust pipe 5 connected to the corresponding inner panel 4 expands during heating.

The sectional view according to FIG. 2 shows two different embodiments A and B, separated from one another by the section line I-I. The collar 8 and the cone structure 10 as well as the contour 12 and the cone, partial cone or frustoconical shaped seat 13 have a fully circumferential configuration in a circumferential direction 14 in the embodiment A shown on the left side of FIG. 2. Only the contour 12 or the cone, partial cone or frustoconical shaped seat 13 can have an interruption in the area of a contact or joint zone 15, in which an upper shell 16 of the housing 2 is fastened to a lower shell 17 of the housing 2. As a result, efficient sealing of the corresponding inner panel 4 is achieved at the same time in the area of the collar 8 at the housing 2 in the circumferential direction 14. At the same time, a significant bracing of the housing 2 is made possible by the inner panel 4, which makes it possible, in particular, to remove external moments in the housing 2 due to the inner support at the inner panel 4.

Contrary to this, FIG. 2 shows, in the second embodiment B shown on the right-hand side, a variant in which a plurality of collars 8, which may also be called collar segments 8, are arranged distributed in the circumferential direction 14. A plurality of cone segments 10 may correspondingly also be formed now. Analogously hereto, the contour 12 or the cone, partial cone or frustoconical shaped seat 13 may also be formed now by corresponding individual segments. However, an embodiment is shown in which the contour 12 and the cone, partial cone or frustoconical shaped seat 13 have a continuous configuration in the circumferential direction 14, aside from the interruption in the joint zone 15.

In the left inner panel 4*l* shown on the left side of FIG. 1 as well as in the embodiments according to FIGS. 3 through 8, the housing 2 is equipped in the area of the inner panel 4, on the inner side 11 thereof, with a depression 18, with which the collar 8 meshes. The contour 12, which forms the cone, partial cone or frustoconical shaped seat 13 in profile, is located in this depression 18. Contrary to this, the housing 2 is provided in FIG. 1 in the case of the inner panel 4*r* shown on the right side, in the area of this inner panel 4, on its inner side 11, with an elevation 19, which projects into the interior of the housing 2. The contour 12, which forms the cone, partial cone or frustoconical shaped seat 13 in the profile, is formed at this elevation 19. FIG. 1 shows, purely as an example, a mixed mode of construction, in which the cone, partial cone or frustoconical shaped seat 13 is embodied by means of such a depression 18 for one inner panel 4*l*, while the cone, partial cone or frustoconical shaped seat 13 is embodied by means of such an elevation 19 for the other inner panel 4*r*. It is clear that all cone, partial cone or frustoconical shaped seats 13 are advantageously embodied by means of such a depression 18 or by means of such an elevation 19 in other embodiments, in which a plurality of inner panels 4 are positioned in the housing 2 by means of such a cone, partial cone or frustoconical shaped seat 13.

Corresponding to FIGS. 3 through 8, the inner panel 4 may be axially prestressed at least at a mounting temperature. An axial prestress is indicated by an arrow and designated by 21 in FIGS. 3, 7 and 8. The axial prestress 21 brings about an axially prestressed contact of the cone structure 10 with the cone, partial cone or frustoconical shaped seat 13. The cone structure 10 and the cone, partial cone or frustoconical shaped seat 13 advantageously form a conical sliding fit 22. Such a conical sliding fit 22 can permit an axial as well as a radial relative motion between the inner panel 4 and the housing 2 and couple them with one another in a non-positive (non-fixed) manner and make possible in the process, furthermore, a flat contact between the cone structure 10 and the cone, partial cone or frustoconical shaped seat 13. An axial adjustment between the inner panel 4 and the housing 2 is indicated by an arrow and designated by 23 in FIG. 4. A radial adjustment between the housing 2 and the inner panel 4 is indicated by an arrow and designated by 24 in FIG. 4. The axial prestress 21 is advantageously generated via the exhaust pipe 5, which is supported at the housing 2, on the one hand, and at the inner panel 4, on the other hand.

The axial prestress 21 may already be present at ambient temperature, namely, if the exhaust pipe 5 is mounted with such an axial prestress. Furthermore, the exhaust pipe 5 can also ensure the axial prestress 21 during the operation of the exhaust system, namely, when the exhaust pipe 5 expands to a greater extent in the axial direction than the housing 2 during the operation of the exhaust system, which is accompanied by a relative axial motion of the inner panel 4 relative to the housing 2.

Furthermore, it is possible to prestress the housing 2 radially inwardly. Such a radial prestress is indicated by an arrow and is designated by 25 in FIGS. 3, 5 and 6. The radial prestress 25 also brings about a prestressed contact between the cone structure 10 and the cone, partial cone or frustoconical shaped seat 13.

Figure 4:
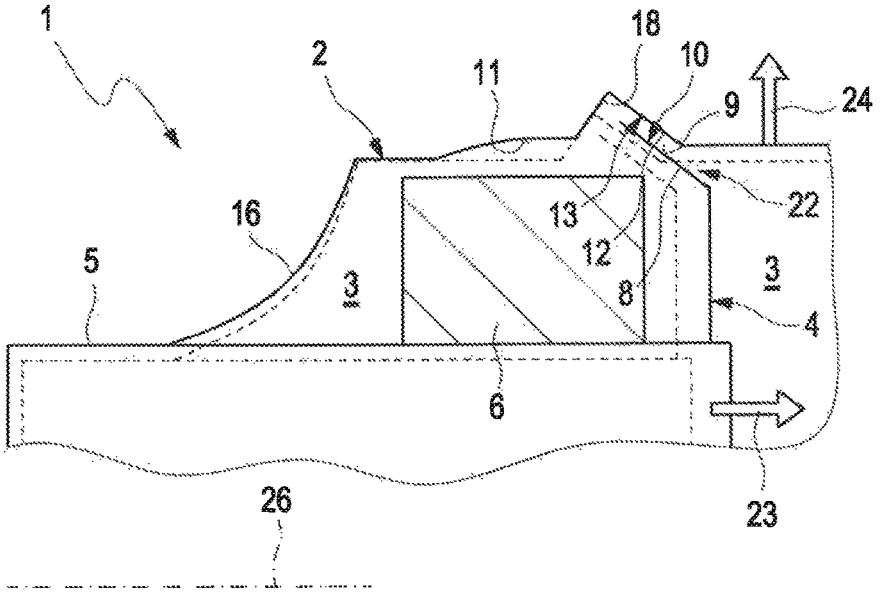
FIG. 4 is a view as in FIG. 3, but in an operating state.

The exhaust pipe 5 and the inner panel 4 advantageously consist of a first material, which is, for example, a ferritic steel. The first material has a first coefficient of thermal expansion. The housing 2 is manufactured from another material, namely a second material, which may be, for example, an austenitic steel. The second material has a second coefficient of thermal expansion. The first coefficient of thermal expansion is lower than the second coefficient of thermal expansion. However, the temperature of the exhaust pipe 5 rises to a markedly greater extent during the operation of the exhaust system than that of the housing 2. As a consequence, the exhaust pipe 5 expands to a greater extent in the axial direction than does the housing 2. Contrary to this, the housing 2 expands to a greater extent in the radial direction than does the inner panel 4. These relative motions occurring during the operation are indicated in FIG. 4. The states for the initial situation, which occurs at ambient temperature, are indicated by broken line. By contrast, the states that become established at the operating temperature are shown by solid lines. As can be seen, the housing 2 expands outwardly relative to the inner panel 4. Further, the inner panel 4 is displaced axially relative to the housing 2 due to the expansion of the exhaust pipe 5. The conical sliding fit 22 can compensate these relative motions 23, 24 and permanently maintain a flat contact between the cone structure 10 and the cone, partial cone or frustoconical shaped seat 13.

The axial direction is defined in this case by an axis 26 that extends at right angles to a plane 27, in which the respective inner panel 4 extends. In the example shown in FIG. 1, a central longitudinal axis 28 of the housing 2 extends parallel to the axis 26. The exhaust pipes 5 also extend essentially parallel to the axis 26 in this example.

Figure 3:
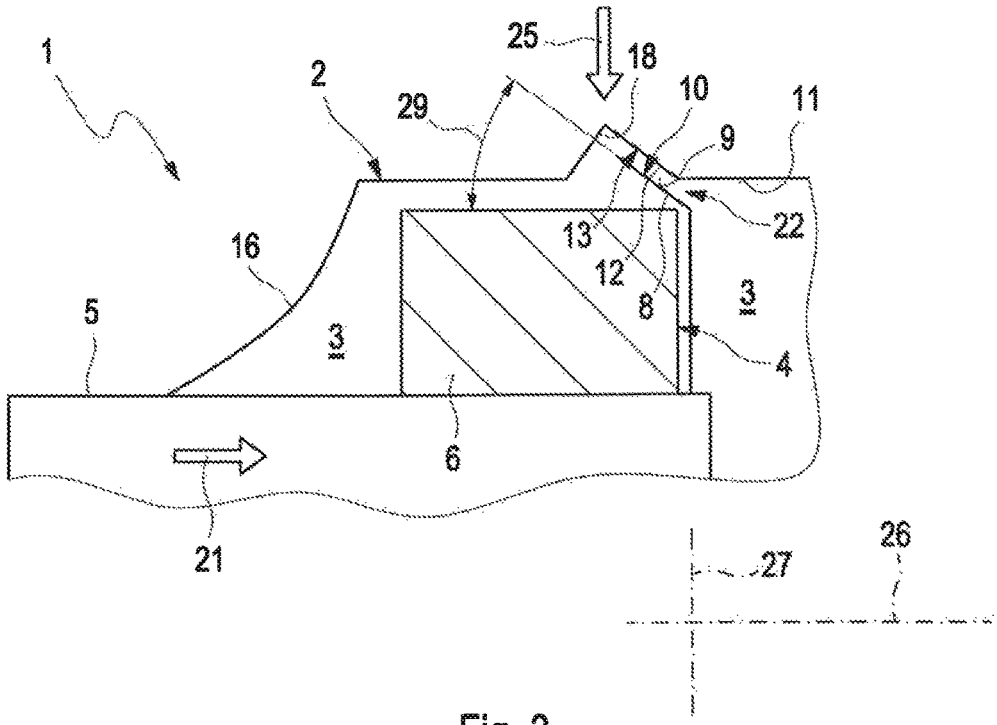
FIG. 3 is an enlarged detail view in the longitudinal section in an initial state.

In order for the conical sliding fit 22 to be able to optimally absorb the relative motions 23, 24 occurring during the operation, a cone angle 29 indicated in FIG. 3, which the cone structure 10 and the cone, partial cone or frustoconical shaped seat 13 have in relation to the axial direction 26, is selected as a function of the coefficients of thermal expansion of the housing 2, inner panel 4 and exhaust pipe 5, namely, such that the radial expansion 24 of the housing 2 relative to the inner panel 4 is compensated by an axial expansion 23 of the exhaust pipe 5 relative to the housing 2 in the conical sliding fit 22. As a consequence, the flat contact between the cone structure 10 and the cone, partial cone or frustoconical shaped seat 13 continues to be present. According to FIG. 4, this means that when the temperature of the muffler 1 rises due to the operation of the exhaust system, a radial expansion 24 of the housing 2, which would lead to the housing 2 being lifted off from the collar 8 in case of the usual mode of construction, will take place, on the one hand, relative to the inner panel 4. However, an axial expansion 23 of the exhaust pipe 5 takes place at the same time, and this expansion generates a corresponding axial adjustment 23 of the inner panel 4 relative to the housing 2. Based on this axial adjustment 23, the cone structure 10 remains in contact with the cone, partial cone or frustoconical shaped seat 13, so that the conical sliding fit 22 can compensate said relative motions 23, 24 caused by thermal effects and the contact is maintained between the cone structure 10 and the cone, partial cone or frustoconical shaped seat 13.

Figure 5:
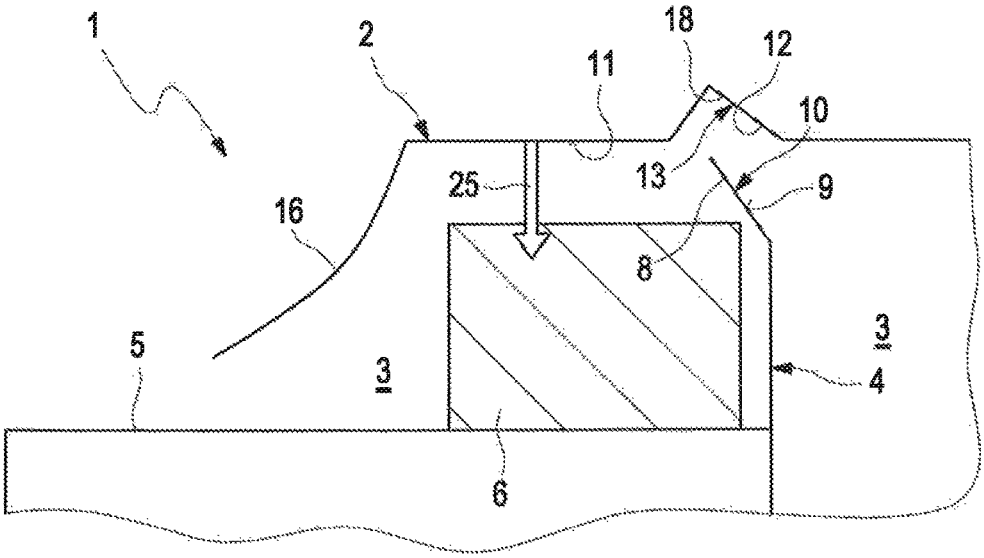
FIG. 5 is a view as in FIG. 3, but during a mounting operation.
Figure 6:
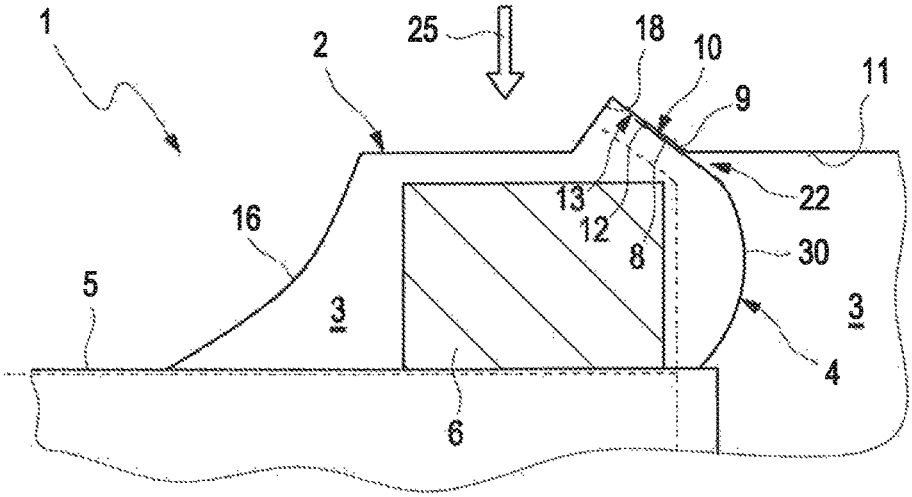
FIG. 6 is a view as in FIG. 5, but after the mounting operation.

According to FIGS. 5 and 6, such a muffler 1 can be manufactured according to a first method such that the inner panel 4 is first inserted into the lower shell 17 of the housing 2, the upper shell 16 is then placed on the lower shell 17 and a radial prestress is generated in the process, which brings about an elastic bulging in the preferential direction of the inner panel 4. Such bulging 30 of the inner panel 4 is shown in FIG. 6 in an exaggerated manner. The upper shell 16 is then fastened to the lower shell 17, which is carried out with the inner panel 4 bulged, so that the housing 2 is subsequently mounted in the radially inwardly prestressed state. The radial prestress 25 is correspondingly present in the mounted state at the mounting temperature.

Figure 7:
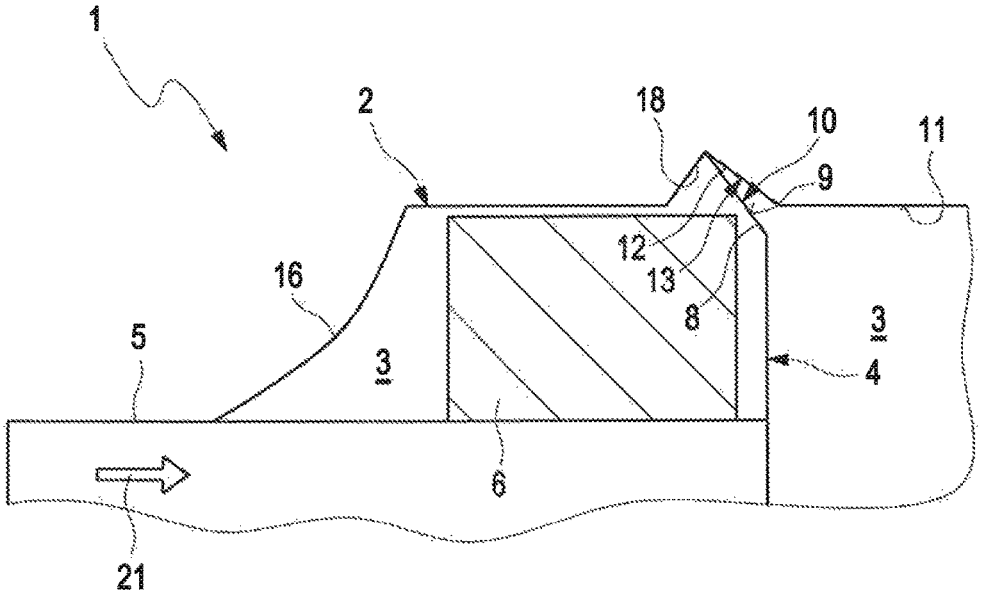
FIG. 7 is a view as in FIG. 5, but during another mounting operation.
Figure 8:
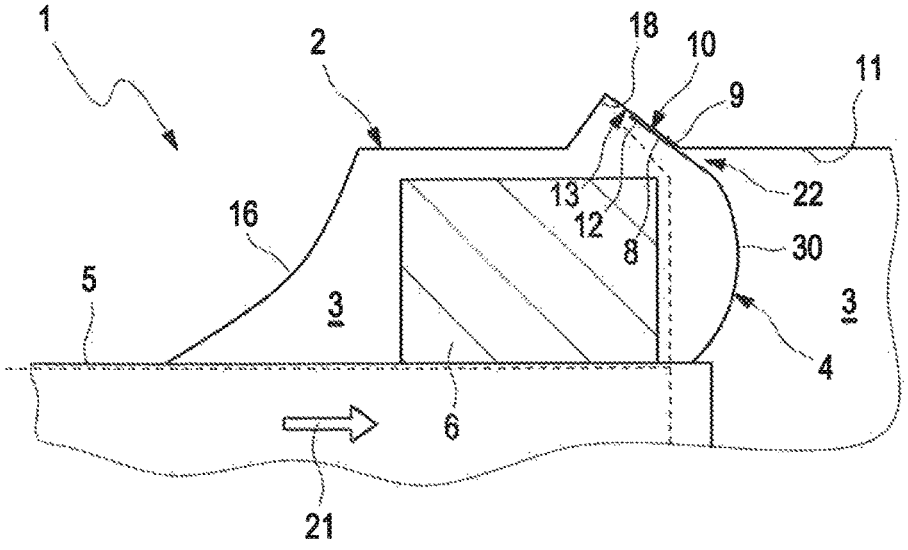
FIG. 8 is a view as in FIG. 7, but after the another mounting operation.

A second manufacturing method, which may be carried out as an alternative to the above-described manufacturing method, is explained in more detail with reference to FIGS. 7 and 8. It is, however, also possible, in principle, to embody the two manufacturing methods cumulatively.

The inner panel 4 with the exhaust pipe 5 fastened to it is first inserted into the lower shell 17 of the housing 2. The upper shell 16 is then placed on the lower shell 17. The exhaust pipe 5 is then pushed inwardly such that the inner panel 4 will bulge elastically in the preferential direction. A corresponding bulging is designated by 30 in FIG. 8 and is shown in an exaggerated form in this case as well. The exhaust pipe 5 is then fastened to the housing 2, while the inner panel 4 is bulged elastically in the preferential direction. The exhaust pipe 5 is thus subsequently mounted in the axially inwardly prestressed state. The corresponding axial prestress 21 is indicated by arrows in FIGS. 7 and 8.

If the above-described two methods are cumulated, the upper shell 16 is placed on the lower shell 17 to generate the radial prestress 25 after inserting the inner panel 4 with the exhaust pipe 5 fastened to it into the lower shell 17. The upper shell 16 is subsequently fastened to the lower shell 17 in order to guarantee or preserve the radial prestress 25 between the housing 2 and the inner panel 4. The exhaust pipe 5 now remains adjustable relative to the housing 2. The exhaust pipe 5 is then pushed inwardly in order to also generate the axial prestress 21. With the axial prestress 21 applied, the exhaust pipe 5 is then fastened to the housing 2 in order also to guarantee or preserve the axial prestress 21 between the inner panel 4 and the housing 2.

While specific embodiments of the invention have been shown and described in detail to illustrate the application of the principles of the invention, it will be understood that the invention may be embodied otherwise without departing from such principles.

What is claimed is:

1. A muffler for an exhaust system of an internal combustion engine, the muffler comprising:

an inner panel; and a housing, the inner panel being arranged in the housing and cooperating with the housing to form at least two chambers, with the inner panel between the at least two chambers, wherein:

the inner panel has at least one collar with an edge, which has an outer side, which faces the housing and forms a cone structure which is a cone, partial cone or frustoconical shaped in profile; and the housing has an inner side, in an area of the inner panel, with at least one contour, which faces the collar and forms a cone structure seat which is a cone, a partial cone or frustoconical shaped seat in profile, which is complementary to the cone structure and with which the cone structure is flatly and loosely in contact, wherein the cone structure and cone structure seat form a conical sliding fit, which permits a relative axial adjustment and a relative radial adjustment between the inner panel and the housing and makes possible the flat contact between the cone and cone structure seat.

2. A muffler in accordance with claim 1, wherein the inner panel has only a single collar extending circumferentially in the closed form.

3. A muffler in accordance with claim 1, wherein the inner panel has a plurality of collars or collar segments extending distributed in a circumferential direction of the inner panel.

4. A muffler in accordance with claim 1, wherein the inner panel is axially prestressed with the cone structure in contact with cone structure seat in an axially prestressed state.

5. A muffler in accordance with claim 1, wherein the housing is mounted in a radially inwardly mounted state so that the inner panel is bulged elastically at least at a mounting temperature and the cone structure is in contact with cone structure seat in a prestressed state.

6. A muffler in accordance with claim 1, further comprising at least one exhaust pipe is fastened to the housing and fastened to the inner panel.

7. A muffler in accordance with claim 6, wherein the exhaust pipe is mounted in an axially prestressed state with the inner panel bulged elastically at least at a mounting temperature and the cone structure is in contact with cone structure seat in a prestressed state.

8. A muffler in accordance with claim 6, wherein the inner panel or the exhaust pipe or both the inner panel and the exhaust pipe are comprised of a first material, which has a first coefficient of thermal expansion, which is lower than a second coefficient of thermal expansion of a second material, of which the housing is comprised.

9. A muffler in accordance with claim 6, wherein the inner panel or the exhaust pipe or both the inner panel and the exhaust pipe are comprised and the housing are comprised of the same material.

10. A muffler in accordance with claim 1, wherein:

the cone structure and the cone seat structure have a cone angle, in relation to the axial direction, that is a function of coefficients of thermal expansion of the housing and of the inner panel or exhaust pipe whereby a radial expansion of the housing relative to the inner panel is compensated by an axial expansion of the exhaust pipe in relation to the housing in the conical sliding fit whereby flat contact is preserved between the cone and cone structure seat.

11. A muffler in accordance with claim 1, wherein the housing is configured as a shell construction.

12. A muffler in accordance with claim 1, wherein in the area of the inner panel, the housing has a depression on an inner side, with which said depression the collar meshes and in which the contour that forms the cone structure seat in profile is located.

13. A muffler in accordance with claim 1, wherein in an area of the inner panel the housing has, on an inner side, an elevation, at which the contour forming the cone structure seat in profile is located.

14. A method for manufacturing a muffler comprising an inner panel, a housing, the inner panel being arranged in the housing and cooperating with the housing to form at least two chambers, with the inner panel between the at least two chambers, wherein the inner panel has at least one collar with an edge, which has an outer side, which faces the housing and forms a cone structure which is a cone, partial cone or frustoconical shaped in profile, the housing has an inner side, in an area of the inner panel, with at least one contour, which faces the collar and forms a cone structure seat which is a cone, a partial cone or frustoconical shaped seat in profile, which is complementary to the cone structure and with which the cone structure is flatly and loosely in contact and the cone structure and cone structure seat form a conical sliding fit, which permits a relative axial adjustment and a relative radial adjustment between the inner panel and the housing and makes possible the flat contact between the cone and cone structure seat, the method comprising the steps of:

inserting the inner panel into a lower shell of the housing;

placing an upper shell on the lower shell, with the inner panel bulged elastically; and fastening the upper shell to the lower shell, while the inner panel is bulged elastically, whereby the housing is subsequently mounted in a radially inwardly prestressed state.

15. A method for manufacturing a muffler, the muffler comprising an inner panel, a housing, the inner panel being arranged in the housing and cooperating with the housing to form at least two chambers, with the inner panel between the at least two chambers, wherein the inner panel has at least one collar with an edge, which has an outer side, which faces the housing and forms a cone structure which is a cone, partial cone or frustoconical shaped in profile, the housing has an inner side, in an area of the inner panel, with at least one contour, which faces the collar and forms a cone structure seat which is a cone, a partial cone or frustoconical shaped seat in profile, which is complementary to the cone structure and with which the cone structure is flatly and loosely in contact and the cone structure and at least one exhaust pipe fastened to the housing and fastened to the inner panel, wherein the cone structure and cone structure seat form a conical sliding fit, which permits a relative axial adjustment and a relative radial adjustment between the inner panel and the housing and makes possible the flat contact between the cone and cone structure seat, the method comprising the steps of:

inserting the inner panel with the exhaust pipe fastened thereto into a lower shell of the housing;

placing an upper shell of the housing on the lower shell of the housing;

pushing the exhaust pipe radially inwardly until the inner panel bulges elastically; and fastening the exhaust pipe to the housing while the inner panel is bulged elastically, whereby the exhaust pipe is subsequently mounted in an axially inwardly prestressed state.

16. A muffler for an exhaust system of an internal combustion engine, the muffler comprising:

an inner panel comprising an outer periphery with at least one collar with a sloped collar edge surface or ramp contour collar edge surface;

a housing with an inner side with at least one seat contour surface, which faces the at least one collar edge surface and has a sloped or ramp contour which is complementary to the collar edge surface, wherein the inner panel is arranged in the housing and cooperates with the housing to form at least two chambers, with the inner panel between the at least two chambers and with the sloped collar edge surface or ramp contour collar edge surface in abutting non-positive contact with the seat contour surface, wherein the cone structure and cone structure seat form a conical sliding fit, which permits a relative axial adjustment and a relative radial adjustment between the inner panel and the housing and makes possible the flat contact between the cone and cone structure seat.

17. A muffler in accordance with claim 16, wherein the inner panel is axially prestressed relative to the housing, with the sloped collar edge surface or ramp contour collar edge surface in contact with seat contour surface in an axially prestressed state.

18. A muffler in accordance with claim 16, wherein the housing is mounted in a radially inwardly mounted state so that the inner panel is bulged elastically at least at a mounting temperature and the sloped collar edge surface or ramp contour collar edge surface is in contact with the seat contour surface in a prestressed state.

* * * * *